United States Patent [19]

Streb

[11] 4,326,374

[45] Apr. 27, 1982

[54] HIGH VELOCITY EXHAUST DIFFUSER AND WATER BAFFLE

[75] Inventor: Herbert R. Streb, Gig Harbor, Wash.

[73] Assignee: The United States of America as represented by the Secretary of the Navy, Washington, D.C.

[21] Appl. No.: 131,341

[22] Filed: Mar. 18, 1980

[51] Int. Cl.[3] ..... F07C 7/00

[52] U.S. Cl. ..... 60/39.09 P; 60/39.5; 440/89

[58] Field of Search ..... 60/39.09 P, 39.5, 264; 440/89; 415/168

[56] References Cited

U.S. PATENT DOCUMENTS

| | | | |
|---|---|---|---|
| 1,469,796 | 10/1923 | Lake . | |
| 2,444,318 | 6/1948 | Warner | 440/89 |
| 2,860,594 | 11/1958 | Kiekhaefer | 440/89 |
| 3,130,541 | 4/1964 | Babbit | 440/89 |
| 3,632,225 | 1/1972 | Smith et al. | 415/168 |
| 3,978,656 | 9/1976 | Murphy | 60/39.09 P |
| 4,007,587 | 2/1977 | Banthin et al. | 60/39.5 |
| 4,099,375 | 7/1978 | Inglee | 60/39.5 |

*Primary Examiner*—Robert E. Garrett

*Attorney, Agent, or Firm*—Richard S. Sciascia; Harvey A. David

[57] ABSTRACT

A diffuser and baffle device prevents sea water intrusion or ingestion into a marine gas turbine engine exhaust system without significantly increasing exhaust back pressure. Inboard and outboard rows of vertical turning vanes are separated by a gap and effect successive bends of the exhaust flow in opposite directions while affording an increase in cross-sectional area. The outboard vanes are slotted at their inboard edge portions, and the inboard vanes are provided with hook-shaped projections defining grooves, whereby water driven into the device is arrested and drained overboard.

9 Claims, 3 Drawing Figures

HIGH VELOCITY EXHAUST DIFFUSER AND WATER BAFFLE

BACKGROUND OF THE INVENTION

This invention relates to engine exhaust baffles for water-craft, and more particularly to an improved apparatus for diffusing the exhaust flow of a gas turbine engine and for preventing intrusion of water into the turbine through the exhaust duct.

Various watercraft, such as surface effect, air cushion, or hydrofoil vessels are powered by gas turbines or other engines that produce a large volume of exhaust gas that is ducted for overboard discharge. In some of these, the discharge is effected at locations and levels close enough to the waterline of the craft or vessel that ingestion or intrusion of water, with resulting catastrophic damage to the engine, becomes a distinct possibility. This is particularly true where the exhaust ducts discharge through ports in the sides or stern of the vessel or craft and the craft is operated at times under circumstances, such as in following seas or when manuevering alongside a ship, that wave and vessel action can slosh or pump water into the exhaust ports and come into contact with turbine blades which are running at temperatures in excess of 1000° F. Present systems attempt to reduce the problem by utilizing long exhaust ducting including a right angle bend just prior to exhaust discharge which significantly reduces usable horsepower by increasing back pressure.

A variety of deflector devices have been provided for a variety of purposes in the engine exhaust streams of certain water and aircraft. U.S. Pat. Nos. 4,007,587 and 4,099,375 disclose examples of vane structures located in, or at the termination of, exhaust ducts of turbine engine powered aircraft such as helicopters for the principal purpose of reducing the exhaust plume and infrared radiation of the exhaust gases and duct structure. U.S. Pat. Nos. 1,469,796 and 2,444,318 disclose diffusion vane structures in the exhaust paths of aircraft in order to enhance their capability of skimming on or over the surface of a body of water.

An exhaust gas deflecting baffle device is disclosed by U.S. Pat. No. 3,130,541 for use in through the stern exhaust pipes of inboard powered boats. That baffle device serves to cool the exhaust gases so as to minimize the tendency thereof to rise and be drawn forward over the stern of the boat.

The foregoing devices, while having exhaust gas diffusing functions in combination with turbine and other engine powered craft, do not address the problem of excluding water that impinges against the craft so as to tend to be driven into the exhaust duct. Accordingly, there exists a need for a simple, inexpensive, and yet effective device for not only diffusing the exhaust of a turbine engine in a watercraft, but also for excluding or rejecting impinging water which would otherwise enter through the exhaust duct and be likely to damage the turbine.

Of course, the introduction of any device in the exhaust system that would produce a material or significant increase in exhaust back-pressure as seen by the engine would also materially reduce the power output available from that engine as well as the operating efficiency thereof. Accordingly, it is desirable that a diffuser or baffle device, if it is to be used in conjunction with an engine exhaust system, be such as to offer little or no back-pressure to the exhaust stream.

SUMMARY OF THE INVENTION

With the foregoing in mind, it is a principal object of the invention to provide an improved engine exhaust diffuser and water baffle device for use in conjunction with a watercraft.

Another object of this invention is to provide an apparatus for substantially excluding any impinging water from entry through the exhaust duct into the engine.

As another important object the invention aims to accomplish the foregoing while imposing little or no increase in exhaust back-pressure on the operation of the engine.

Still another object is the provision of a deflector device utilizing a plurality of turning or gas redirecting vanes that cooperate to allow substantially unimpeded exit of exhaust gases while serving to absorb or extract kinetic energy from water moving toward the engine, whereby said water is stopped in its advance and drains from the apparatus under the influence of gravity.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
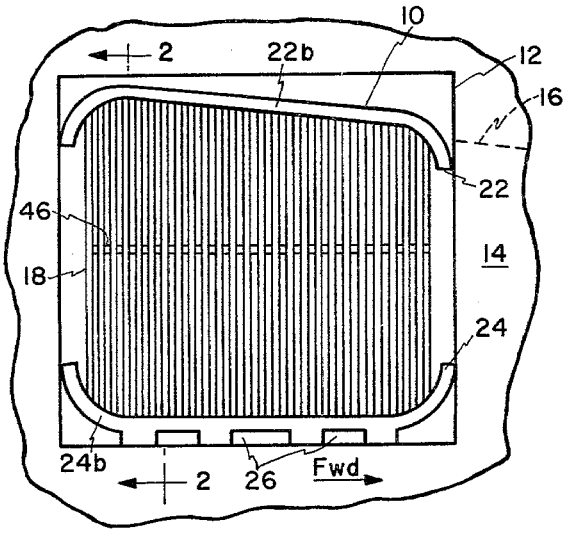
FIG. 1 is a fragmentary elevational view of the side of a watercraft showing an exhaust outlet port in which in mounted an exhaust diffusing water baffle device embodying the present invention.

Referring to FIG. 1, a turbine engine exhaust gas diffuser and water baffle device embodying the invention is indicated generally at 10 and is shown in position in an exhaust port 12 formed in the side 14 of a vessel, for example a surface effect craft. An exhaust duct 16 runs aft from a forwardly located gas turbine (not shown) and connects to the exhaust port 12. The duct 16 in this example approches the exhaust port 12 at an acute angle of about 40° relative to the fore and aft centerline of the vessel, and discharges hot exhaust gases overboard through the diffuser and baffle device 10 in the port.

Figure 2:
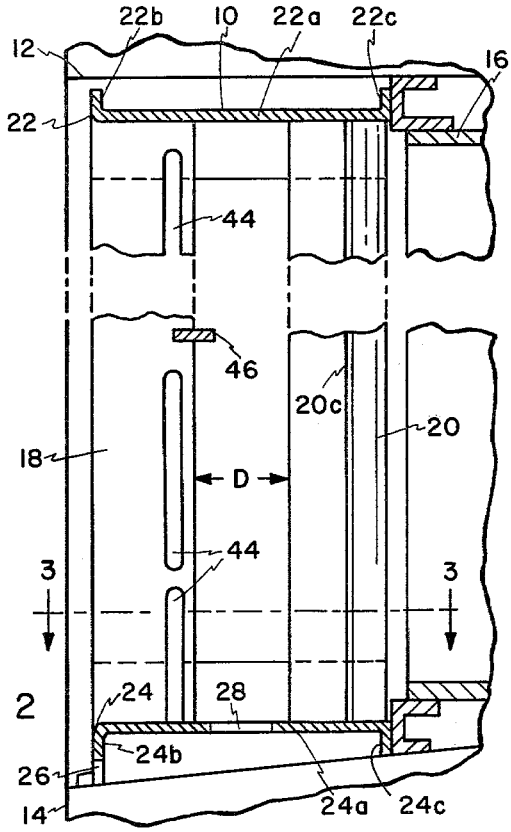
FIG. 2 is an enlarged vertical sectional view of the device taken substantially along line 2—2 of FIG. 1, with a mid portion broken out.
Figure 3:
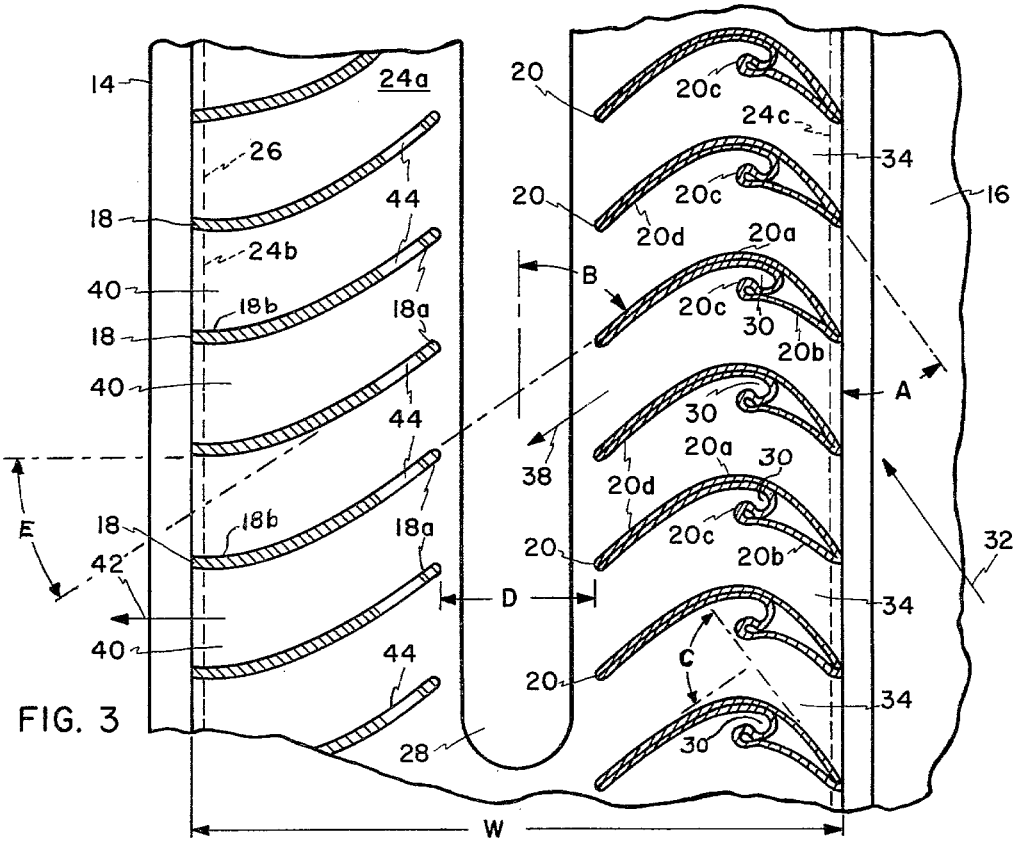
FIG. 3 is a fragmentary sectional view taken substantially along line 3—3 of FIG. 2, but on an enlarged scale.

Referring additionally now to FIGS. 2 and 3, the device 10 comprises spaced outer and inner rows of parallel, horizontally spaced, vertically extending turning vanes 18 and 20 which serve to redirect and diffuse the flow of hot exhaust gases from duct 16, and to prevent entry of water into that duct. The vanes 18 and 20 are supported by rigid connection at their upper and lower ends to upper and lower frame segments 22 and 24 constituting a split or divided frame means that allows for expansion of the vanes 18,20 along their vertical lengths when heated by hot exhaust gases. The frame segments are formed as channel members or beams that are curved at opposite ends and have central web portions 22*a*, 24*a*, to which the upper and lower ends of the vanes 18 and 22 are welded. Side flanges 22*b*, 22*c*, 24*b*, 24*c* impart rigidity to the frame segments. The flange 24*b* is provided with notches 26 that serve as drain scuppers or openings for draining overboard any water that is stopped by the device 10 from passing into the exhaust duct 16, as will be described later.

The row of outer vanes 18 is spaced outwardly of the row of inner vanes 20 by a gap or distance D and a plurality of water drain slots 28 are formed through the horizontal web portion 24*a* of the lower frame segment 24 between the rows of vanes.

As is best illustrated in FIG. 3, the inner vanes 20 are curved or bent in the the middle regions 20*a* of their cross-sections and are provided with curving, wedge shaped leading or inboard edge portions 20*b* that terminate, on the concave sides of those vanes, in hook portions 20*c* defining vertical grooves 30. The inboard edge portions 20*b* lie at acute angles A relative to the frame segments, and in this example to the fore and aft axis of the vessel, so as to present substantially unobstructed entry by exhaust gases flowing in the direction of the arrow 32 from the duct 16 into the curved spaces or channels 34 defined between the vanes. In the embodiment being described the angles A are 40° or equal to the approach angle of the duct 16. That is to say, the portions 20*b* are substantially aligned with the incoming gas flow.

The trailing or outboard edge portions 20*d* of the vanes 20 are disposed at angles B relative to the frame means and the fore and aft axis of the vessel so that gases exiting the channels 34 flow in the direction of the arrow 38. In this embodiment the angles B are 53½°. It will be noted that the entrances or openings of the grooves 30 face downstream of the exhaust gas flow in the channels 34, and that the cross-sectional area of each of those channels increases in the direction of flow as the flow passes downstream of the hook portions 20*c*.

While the vanes 20 can be solid in section, in the interest of strength and lightness it is advantageous to form them of sheet metal folded and bent as illustrated so as to leave a void in the curved, wedge shaped portions 20*b*.

The vanes 18 are curved in section with the convex sides of the vanes facing generally forwardly, that is opposite to the direction in which the convex sides of the vanes 20 face. The inboard edge portions 18*a* of the vanes 18 are substantially aligned with the outboard edge portions 20*d* of corresponding ones of the vanes 20. The vanes 18 define therebetween a plurality of curved flow channels 40 that are aligned with the channels 34 so as to receive exhaust gas flowing in the direction of arrow 38. The curvatures of the vanes 18 and the positioning of the outboard edge portions 18*b* are such that the curved channels 40 therebetween increase in cross-sectional area going in the direction of gas flow and redirect the exhaust gases outwardly for discharge in directions substantially normal to the fore and aft axis of the vessel, as shown by the arrow 42.

The inboard edge portions of the vanes 18 are provided with vertical slots 44 which aid in the exclusion and drainage of water that may enter the device 10 as a result of wave action, sloshing, or the like.

A horizontal stringer or brace 46 spans the row of vanes 18 and is advantageously fixed to each of those vanes for the purpose of strengthening thereof.

In one practical embodiment of the device 10 there are provided about forty-eight vanes 18 in the outboard row and a like number in the inboard row of vanes 20. The vanes in each row are located on one-inch centers, while the frame segments 22,24 are six inches in width W, the drain slots 28 are approximately 1.0 inch in width, and the rows 18 and 20 are separated by a space or gap D of about 1.5 inch.

MODE OF OPERATION

In normal operation hot exhaust gases from the turbine flow through duct 16 and enter the channels 34 between vanes 20 at a high velocity. The curvatures of the vanes 18 cause the flow to follow an anular bend C of about 86½°, where $C=180°-(A+B)$, while at the same time allowing some expansion thereof due to the increases in cross-sectional areas of the channels 34. The hot gases cross the gap D between the vanes 20 and 18, undergoing some further expansion therebetween, and enter the channels 40. The curvatures of the vanes 18 redirect the flow to follow a smaller reverse angular bend E of about 36½°, where $E=180°-(B+90°)$, to discharge normal to the side of the vessel in an expanded and diffused condition.

The two bends provide roughly equal relative area increases while reducing the net bend or flow turning angle. The net area increase is approximately 55%, or in the ratio of 1:1.55. A conservative estimate of the total loss coefficient for two approximately 90° bends is $0.5q_1$, where $q_1$ is the dynamic pressure or velocity head at the entrance to the device 10. The significance of these factors will become apparent as the description proceeds.

When water happens to be propelled or otherwise caused to enter the device 10 in a direction opposite to arrow 42 through the vanes 18, some of the water, in tending to maintain a straight path, will pass through the vertical slots 44 and, through the effect of gravity and slowing by exhaust gases flowing along path 32, will drop to the floor of the device as defined by the web portion 24*a* of frame segment 24, and will run through the drain slots 28, the scuppers 26, and overboard out of the port 12.

Water that enters with sufficient velocity to be deflected by the vanes 18 and carry across the gap D into the channels 32 between vanes 20 will be forced by the incoming exhaust gases to follow the concave surface of the mid portions 20*a* thereof and be trapped by the grooves 30. Water so trapped will fall by gravity to the device floor and run out through the slots 28 and scuppers 26, thereby preventing intrusion into the duct 16 and possible contact with the turbine blades.

In addition to thereby effectively blocking intrusion or ingestion of water, the device 10 avoids the problem of increased exhaust back pressure experienced in the prior systems. Approximate or rough calculations can readily be made to illustrate that fact by using the Bernoulli equation:

Eq. 1

$$P_1 - P_2 = \frac{\rho}{2}[V_2^2 - V_1^2] = \frac{\rho}{2} V_1^2 \left[\left(\frac{V_2}{V_1}\right)^2 - 1\right],$$

where:

$V_1$=entry velocity $V_2$=exit velocity $\rho$=density (slugs /Ft$^3$)

P=static pressure (psf).

The dynamic pressure or velocity head $q_1$ may be expressed as:

$$q_1=(\rho/2)V_1^2, \text{ and} \qquad \text{Eq. 2.}$$

from mass conservation:

$$\frac{V_2}{V_1}=\frac{A_1}{A_2}=\frac{1}{1.55}=.64 \qquad \text{Eq. 3}$$

where $A_1$=entry area ($Ft^2$), and $A_2$=exit area ($Ft^2$).

By substitution in Eq. 1, $$P_1-P_2=q_1[(.64)^2-1]=-.59\,q_1.$$

It will be noted from the above that there is a negative loss coefficient due to the area increase which substantially offsets the earlier mentioned positive value of $0.5q_1$ due to the bends effected by the vanes 18 and 20. Accordingly, the net effect on back pressure to be expected from the device 10 is that there would be no added back pressure (or possibly some negative back pressure), and that engine shaft horsepower would not be degraded.

Actual tests were performed with a turbine engine of 3750 horsepower, maximum exhaust velocity of 400 ft/sec, and a thrust of 497 pounds. The exhaust gas temperature was 1200° F. and the exhaust area approximately 525 $in^2$. Testing was conducted with the device 10 installed and removed and exhaust pressures recorded for all power levels for both conditions. The increased exhaust pressure with the diffuser and baffle device 10 installed was recorded at 0.96 psf or equivalent to 0.184 in $H_2O$. This would represent a loss of approximately 2 horsepower.

A water test was conducted on the removed baffle device 10 with a high pressure fire hose. The stream of water was directed at various angles to the vanes. As the water passed through the two rows of vanes, the energy was quickly dissipated and what water did go all the way through was nothing more than a heavy mist which terminated about six inches beyond the inboard vanes.

From the foregoing it will be appreciated that the invention eliminates the need for long exhaust ducting and right angle bends in the ducting. The device minimizes losses due to back pressures and provides adequate protection against the intrusion or ingestion of sea water.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. An exhaust gas diffuser and water baffle device for use in combination with a watercraft having an engine that produces high velocity exhaust gases which are carried through a substantially horizontal duct for overboard discharge, said device comprising:

inner and outer rows of elongated, parallel spaced vanes disposed in the flow path of said gases substantially immediately prior to said discharge;

frame means for supporting opposite ends of said vanes with a predetermined gap between said rows;

said vanes each being curved in section to present convex and concave sides, said vanes of said inner and said outer rows being curved in opposite directions such that the vanes of said inner row define first curved flow channels therebetween that effect a first predetermined angular bend in said flow path and the vanes of said outer row define second curved flow channels that effect a reverse, second predetermined angular bend in said flow path; and said vanes of said inner row being characterized by hook shaped projections on the concave sides thereof defining grooves that have openings facing with the direction of flow of said gases;

whereby water propelled into said device in directions counter to flow of said gases with sufficient force to cross said gap is arrested in said grooves so as to prevent entry into said duct and engine.

2. A diffuser and water baffle device as defined in claim 1 and wherein:

said vanes of said inner row have leading edge portions aligned with the flow of gases in said duct;

said first plurality of curved flow channels increase in cross-sectional area in the direction of gas flow;

said vanes of said second row have leading edge portions aligned with the flow of gases crossing said gap; and said second plurality of curved flow channels increase in cross-sectional area in the direction of gas flow;

whereby increases in pressures in said duct which would result from said first and second angular bends are substantially avoided.

3. A diffuser and water baffle device as defined in claim 2, and wherein:

said vanes of said inner and outer rows are horizontally spaced and have their long dimensions substantially vertical; and said rows are disposed at a first predetermined angle relative to the fore and aft centerline of said craft.

4. A diffuser and water baffle device as defined in claim 3, and wherein:

said frame means comprises upper and lower frame segments respectively connected to the upper and lower ends of said vanes;

at least one of said frame segments being movable relative to the other to accommodate thermal expansion and contraction of said vanes.

5. A diffuser and water baffle device as defined in claim 4, and wherein:

said lower frame segment comprises a horizontal web portion having a drain opening defined therein and substantially aligned with said gap between said rows of vanes, whereby water propelled into said device and arrested in its travel therethrough drains through said drain opening.

6. A diffuser and water baffle device as defined in claim 5, and wherein:

said leading edge portions of said vanes of said outer row are characterized by vertical slots whereby a portion of water propelled into said device passes through said slots and is slowed or arrested by said gases so as to drain through said drain opening.

7. A diffuser and water baffle device as defined in claim 6, and wherein:

said first and second angular bends in said flow path produce a net angular bend which directs said discharge substantially normal to said centerline of said craft.

8. A diffuser and water baffle device as defined in claim 7, and wherein:

said gas flow through said duct approaches said device at about 40° relative to said centerline;

said first predetermined angular bend is about 85½°; and said reverse second predetermined angular bend is about 35½°;

whereby a net angular bend of about 50° is imparted to said gas flow to result in said discharge substantially normal to said centerline.

9. A diffuser and water baffle device as defined in claim 8, and wherein:

said upper frame segment comprising upwardly extending inner and outer side flanges;

said lower frame segment comprising downwardly directed inner and outer side flanges; and said downwardly directed, outer side flanges being characterized by notches therein adapted to serve as drain scuppers for draining overboard of water trapped in said device.

* * * * *